United States Patent [19]

George

[11] Patent Number: 4,654,986

[45] Date of Patent: Apr. 7, 1987

[54] VACUUM FITTING SKI BOOT

[76] Inventor: Frederick W. George, 6009-B Sunrise Blvd., Citrus Heights, Calif. 95610

[21] Appl. No.: 827,092

[22] Filed: Feb. 7, 1986

[51] Int. Cl.[4] ..... A43B 5/04; A43B 7/14

[52] U.S. Cl. ..... 36/119; 36/93; 36/117

[58] Field of Search ..... 36/117–121, 36/93, 88, 71, 2

[56] References Cited

U.S. PATENT DOCUMENTS 3,758,964 9/1973 Nishimura ..... 36/119

FOREIGN PATENT DOCUMENTS 1901606 8/1970 Fed. Rep. of Germany ..... 36/119
2144826 3/1973 Fed. Rep. of Germany ..... 36/93
2292442 6/1976 France ..... 36/120
2378467 8/1978 France ..... 36/117
2541095 8/1984 France ..... 36/117

*Primary Examiner*—James Kee Chi
*Attorney, Agent, or Firm*—Flehr, Hohbach, Test, Albritton & Herbert

[57] ABSTRACT

A ski boot which creates a vacuum between the boot and user's foot, ankle and lower calf. The boot includes a rigid shell formed in sections which permit articulation, and padded liners are mounted within the shell. A flexible sheath secured to the shell forms an hermetical seal about the calf of the user. Means is provided for maintaining a partial vacuum within the boot. The partial vacuum causes both contraction of the boot shell and expansion of the foot to establish a close fit of the foot within the boot. The boot provides lateral stiffness while permitting forward flexing, and the close fit permits the user to achieve precise control during skiing.

10 Claims, 9 Drawing Figures

VACUUM FITTING SKI BOOT

This invention relates in general to ski boots, and more particularly relates to Alpine ski boots for downhill skiing.

Alpine or downhill-type ski boots of conventional design typically incorporate a rigid outer shell having a padded inner liner within which the user's foot and ankle are fitted. The shell opens and closes to permit entry and withdrawal of the foot, and releasable straps are provided to adjust tightness of the "fit" within the boot.

In downhill skiing it is desirable to achieve a close fit of the foot within the boot for optimum "foot feel" while skiing. It is also desirable to provide a degree of forward flexing of the lower leg relative to the ski while maintaining later stiffness within the boot for proper ski edge control.

Conventional methods of attempting to achieve closely-fitting ski boots have included the expedient of applying a vise-like pressure about the foot and ankle by extreme tightening of the buckles and straps about the boot. Another method is to cast a slipper of an elastomeric material within the shell with the slipper conforming to the contour of the user's foot so that when the shell is buckled together the slipper is pressed into tight-fitting contact about the foot. This latter expedient is exemplified by the ski boot construction disclosed in U.S. Pat. No. 4,120,064 issued Oct. 17, 1978. These conventional, tight-boot fitting designs have a number of problems and limitations. These include the "tourniquet effect" caused by the contact pressure against the user's foot resulting in blood circulatory problems as well as discomfort. In many of the prior art ski boots the methods for achieving the close fit also result in an extremely stiff boot about the foot and ankle which limits the forward flexing capability.

It is a general object of the invention to provide a new and improved Alpine-type ski boot which achieves a close fit of the foot within the boot.

Another object is to provide a ski boot of the type described which achieves a close fit between the user's foot and boot while obviating circulatory problems and discomfort.

Another object is to provide a ski boot of the type described which permits a close fit of the foot within the boot for improved "foot feel" or kinesthetic feedback.

Another object is to provide a close-fitting Alpine ski boot with lateral stiffness as well as forward flexing capability.

The invention in summary includes a ski boot comprising a rigid outer shell which fits about the user's ankle and foot. The shell is shaped into articulated sections which provide lateral support while permitting forward flexing relative to the sole and ski. A flexible sheath connects with the shell and conforms about the outer contour of the foot, ankle and calf to form an hermetical seal. A partial vacuum is formed within the sheath to cause contraction of the shell and expansion of the foot without creating objectionable pressure on the user's skin.

The foregoing and additional objects and features of the invention will appear from the following specification in which the several embodiments have been set forth in detail in conjunction with the accompanying drawings.

Figure 2:
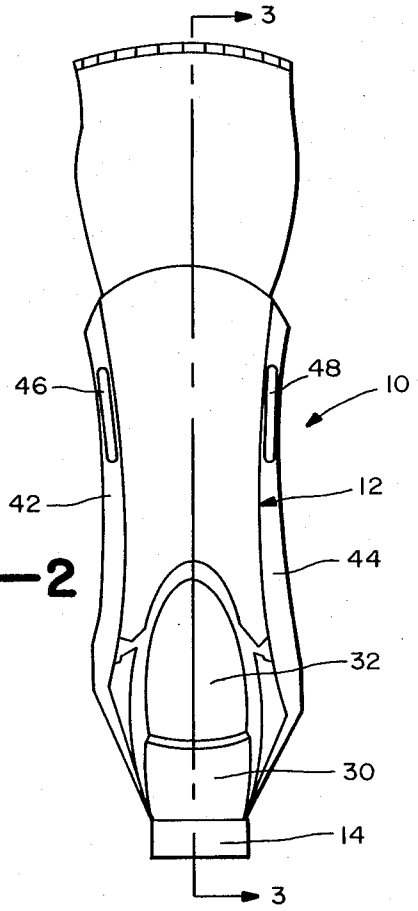
FIG. 2 is a rear elevational view of the ski boot of FIG. 1.

in the drawings FIGS. 1–7 illustrate one preferred embodiment of the invention providing a ski boot 10 adapted for use with an Alpine ski, not shown, for downhill skiing. Ski boot 10 comprises a rigid outer shell 12 mounted above a sole 14 adapted to fit into the bindings of the ski.

Figure 1:
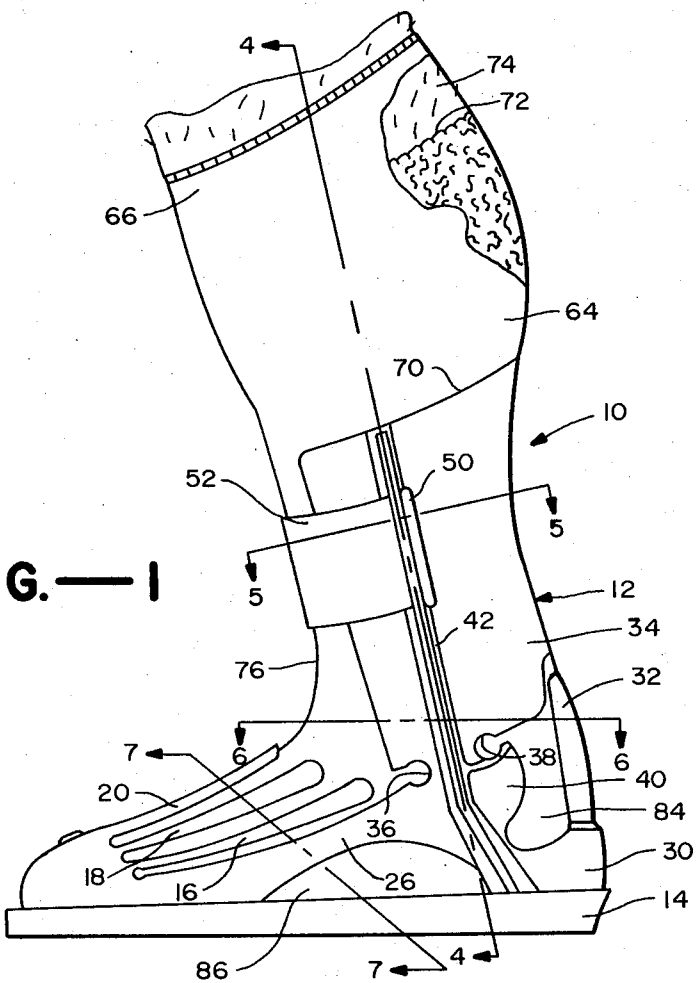
FIG. 1 is a side elevational view of a ski boot according to one embodiment of the invention.
Figure 4:
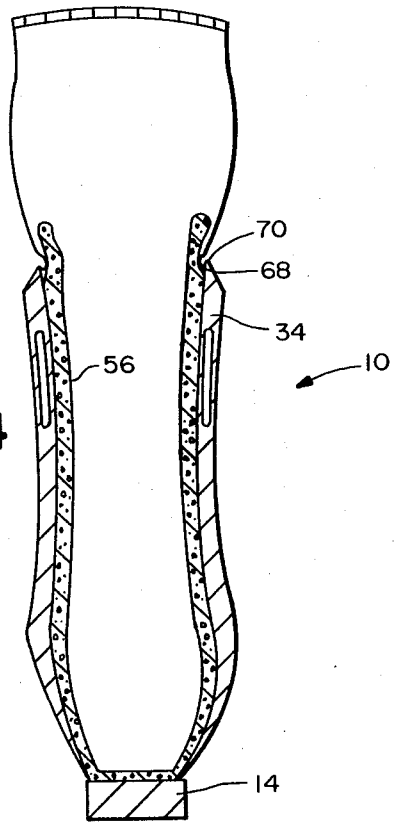
FIG. 4 is a vertical cross-sectional view taken along the line 4—4 of FIG. 1.
Figure 5:
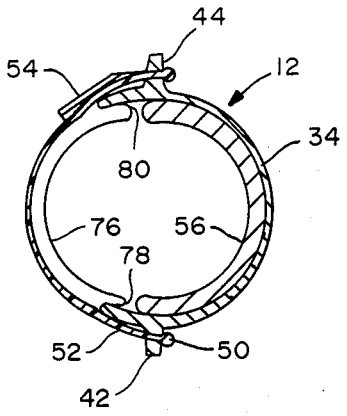
FIG. 5 is a cross-sectional view taken along the line 5—5 of FIG. 1.
Figure 6:
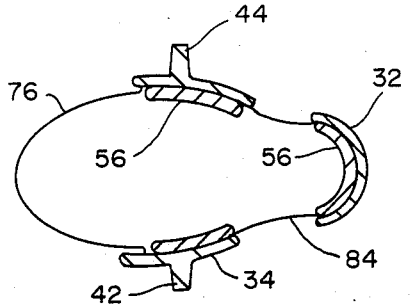
FIG. 6 is a horizontal cross-sectional view taken along the line 6—6 of FIG. 1.

Outer shell 12 is formed of sections which are sized and arranged to provide stiffness as well as articulation for controlled flexing during skiing. The sections of the shell include a rounded toe portion 15 above the forward end of the sole and a plurality of stiffening battens 16–24 (FIGS. 1 and 7) extending from the toe portion in parallel, spaced-apart relationship above the instep of the foot. Extending rearwardly from the toe portion below the battens are a pair of side plates 26, 28 on either side of the instep, and the side plates join with the forward sides of a heel portion 30 mounted above the rear of the sole. An ogive-shaped heel plate 32 is formed integral with and extends above the heel portion. The shell also includes an upper section 34 having a forwardly open concave shape generally conforming with the back portion of the user's ankle and calf. Articulation means for joining upper section 34 with the lower portions of the shell include pairs of semi-circular cutouts 36, 38 formed on each side. The forward cutout 36 shown on the left of FIG. 1 is formed between side plate 26 and the lower portion of section 34, and the opposite cutout 38 is formed between the upper extension 40 of heel portion 30 and the upper section. Outwardly projecting, vertically extending ridges 42, 44 are formed integral with opposite sides of shell upper section 34, and the ridges extend downwardly over the narrowed section between the cutouts and along heel portion 30 where the ridges merge with the sole. The ridges increase the lateral stiffness of the shell. Slots 46, 48 are formed through the upper portions of the ridges, and the enlarged ends 50 of a strap 52 with a quick-release buckle 54, FIG. 5, are mounted through and captured in the slots.

Outer shell 12 is formed of a material providing strength and rigidity with a degree of resiliency permitting flexing at the narrowed portions between the pairs of cutouts 36, 38. A synthetic polymer such as one of the polyvinyl chloride products is suitable for this purpose.

Figure 7:
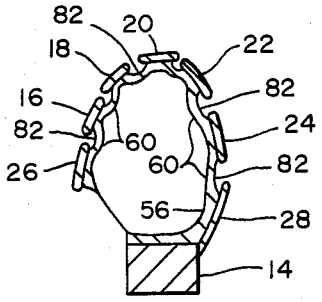
FIG. 7 is a cross-sectional view taken along the line 7—7 of FIG. 1.

A padded liner 56 formed of a suitable conformable material such as felt or foam plastic is mounted on the inside surfaces of the outer shell sections. At the articulation zone 58 between the upper portion of heel plate 32 and the lower edge of upper section 34 the liner is of reduced thickness to permit flexing. Liner portions 60 bridge across the spacing between the battens, as shown in FIG. 7, to provide flexible diaphragms which permit a degree of expansion and contraction of the instep portion of the boot to facilitate entry and withdrawal of the user's foot. A padded insole 62 is mounted within the boot above the sole.

Figure 3:
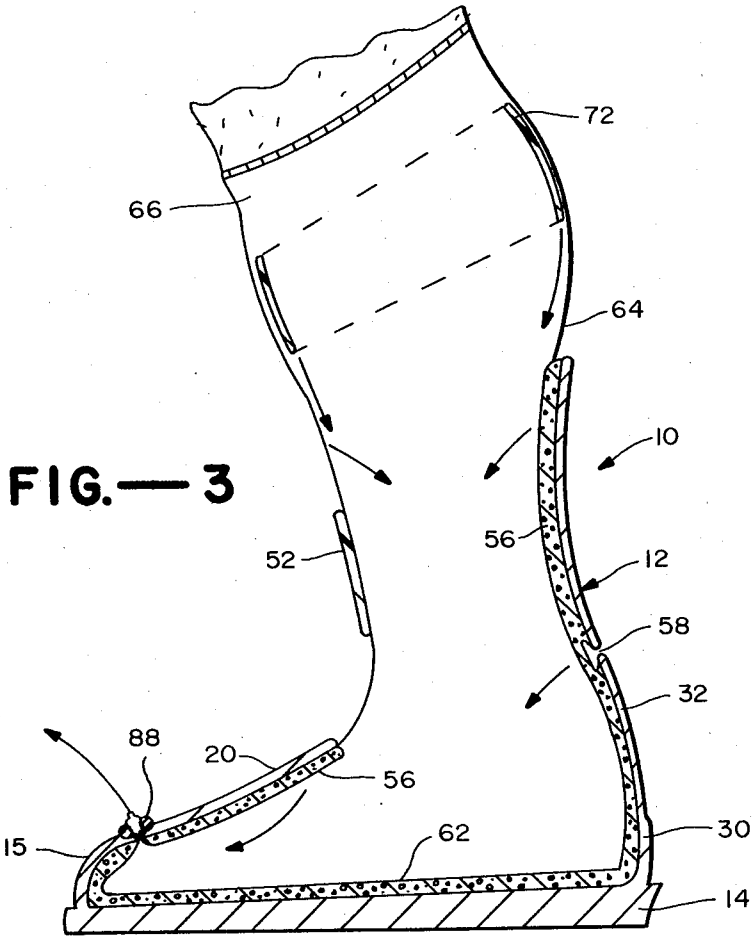
FIG. 3 is a vertical cross-sectional view taken along the line 3—3 of FIG. 2.

A sheath 64 formed of a suitable flexible, gas-impervious material such as latex rubber cooperates with rigid shell 12 to form an hermetical seal about the foot, ankle and lower calf. In the embodiment of FIGS. 1–7 the sheath includes an annular sealing cuff 66 sized to closely fit about the upper calf, and with the lower edge of the cuff secured by an hermetically-sealed joint 68 about the rim 70 of shell upper section 34. FIGS. 1 and 3 show the upper extremity of a typical sock 72 which would be worn by the user. The upper portion of sealing cuff 66 laps over the sock to contact and form a leak-proof seal with the portion of the user's skin 74 above the sock. A forward extension 76 of the sheath extends downwardly and is joined through hermetical seals with the forward edges 78, 80 of upper section 34. The sheath also includes finger-like portions 82 which extend between and are hermetically sealed with the edges of the battens 16–24 as well as side plates 26, 28. Additional portions of the sheath cover over and are hermetically sealed with the edges of the pairs of cutouts 36, 38, the heel portion area 84, as well as the crescent-shaped area 86 below the side plates. These portions of the sheath function as flexible diaphragms which permit relative movement between the separate sections of the shell while maintaining the hermetical seal.

A one-way check valve 88 is mounted in the toe portion, and the valve communicates through liner 56 to the interior of the boot. Valve 88 is adapted for connection with a source of vacuum, such as a vacuum pump, for creating a partial vacuum within the boot. Alternatively, a small vacuum pump can be mounted on the boot for direct connection with the valve.

Figure 8:
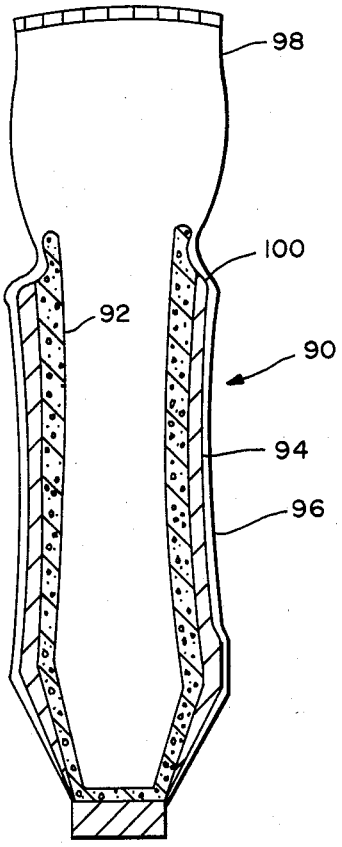
FIG. 8 is a vertical cross-sectional view similar to FIG. 4 illustrating another embodiment of the invention.

FIG. 8 illustrates another embodiment of the invention providing a ski boot 90 incorporating a rigid shell 94 formed with sections substantially identical to that described for the embodiment of FIGS. 1–7. In this embodiment a flexible sheath 96 covers the entire shell and has an integral portion 98 extending upwardly above the upper rim 100 of the shell to form the cuff which provides the leak-proof fit about the user's calf. Padded liner 92 of a suitable conformable material is mounted on the inside surfaces of the rigid shell.

Figure 9:
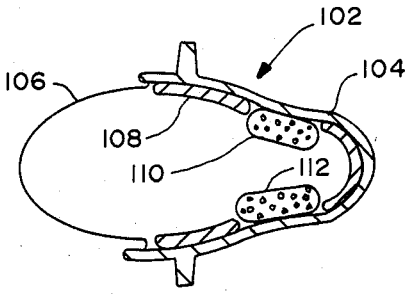
FIG. 9 is a horizontal cross-sectional view of the ski boot according to another embodiment of the invention.

FIG. 9 illustrates another embodiment of the invention providing a ski boot 102 with means to provide controlled close fit between discrete portions of the foot and the ski boot. In this embodiment a rigid outer shell 104 and flexible sheath 106 are in accordance with the embodiment of FIGS. 1–7. FIG. 9 illustrates a section of the ski boot similar to the section shown in FIG. 6. A padded liner 108 is mounted within the shell. On opposite insides of the boot along the forwardly concave shell section adjacent the hollow portions of the user's ankle a pair of expandable bladders 110, 112 are mounted. These expandable bladders are comprised of an elastic-walled, closed cell foam material, such as polyurethane foam. This material is characterized in comprising a large plurality of closed cells containing a gas such as air. When the partial vacuum is created within the boot, the bladders, which are within the area of vacuum, expand due to the internal gas pressure within the cells. This expansion causes the cells to grow in size and closely fit with the adjacent portion of the user's foot. The degree of expansion can be varied by varying the pressure within the cells prior to installation within the boot, thereby providing a degree of custom fitting of the boot to a particular user. In addition, the bladders can be incorporated as a part of the padded lining of the boot, as desired.

The use and operation of the invention will be described in relation to the embodiment of FIGS. 1–7. With buckle 54 released the sheath 76 is sufficiently flexible to permit the user's foot to be inserted down into the boot, with the flexible diaphragms 60 permitting expansion of the distance between the battens 16–24 over the instep. Strap 52 is then placed across the user's shin and the quick-release buckle is secured. Valve 88 is connected to the source of vacuum which is operated to withdraw air from the boot to create a partial vacuum. As the vacuum is drawn down the upper portion of cuff 66 forms an hermetical seal with the portion of the user's skin above the sock. The vacuum creates an extremely close fit between the foot and boot from expansion of the foot simultaneous with contraction of the boot shell. The contraction of the boot shell is realized from the portions of the sheath which form the flexible diaphragms between the rigid shell sections.

After the desired level of vacuum is achieved within the boot the vacuum source is disconnected from valve 88. With the boot mounted by the bindings to the ski, the user can now ski with precise control due to the enhanced kinesthetic feedback or "foot feel" from the extremely close fit of the foot within the boot due to the partial vacuum. This partial vacuum achieves a close fit without creating contact pressure on the foot, ankle or lower calf. The close fit is thereby maintained without creating blood circulatory problems or discomfort. During skiing the user has a degree of forward and reverse flexing from the relative movement permitted between the upper and lower sections of the shell.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A ski boot for supporting the foot, ankle and lower calf of a user, comprising the combination of a rigid outer shell to fit about the ankle and foot and provide lateral support while permitting forward flexing of the ankle and foot, a sole below the shell for mounting on a ski or other platform, flexible sheath means cooperating with the shell for forming an hermetical seal about the foot, ankle and calf, and means for maintaining a partial vacuum between the sheath means and the foot, ankle and calf whereby the boot and sheath are caused to at least partially conform in close-fitting contact with the ankle and foot without creating objectionable pressure on the user's skin.

2. A ski boot as in claim 1 which includes a conformable liner between the inside of the shell and portions of the user's foot and ankle.

3. A ski boot as in claim 2 in which the flexible sheath means comprises a lower portion which is closely wrapped about the outer surface of the shell and an upper portion which fits about the user's calf and forms an hermetical seal therewith when said partial vacuum is maintained.

4. A ski boot as in claim 2 in which the flexible sheath means includes an annular cuff secured by a gas impervious seal about the upper portion of the shell with the cuff forming an hermetical seal about the user's calf when said partial vacuum is created.

5. A ski boot as in claim 1 in which the outer shell includes a lower rigid section mounted above the sole and enclosing a portion of the periphery of the foot, an upper rigid section having a forwardly open concave shape generally conforming with the back portion of the user's ankle and calf, and articulation means for joining the upper and lower sections of the shell to permit forward and reverse flexing of the foot and ankle.

6. A ski boot as in claim 5 which includes strap means for extending across the shin of the leg and releasably securing with opposite sides of the upper portion of the shell.

7. A ski boot as in claim 5 in which the sheath means includes a front portion extending across the front edges of the upper section of the shell to permit lateral expansion and contraction of the shell upper section to facilitate entry of the user's foot and ankle into the boot.

8. A ski boot as in claim 1 in which the shell includes a plurality of elongate rigid battens extending in parallel spaced-apart relationship above the instep of the foot, and the sheath means includes flexible diaphragm means extending between the battens to permit relative movement between the battens and thereby facilitate entry of the user's foot and ankle into the boot.

9. A ski boot as in claim 1 in which the means for maintaining the partial vacuum includes a one-way valve mounted on the boot for withdrawing air from within the boot and sheath means.

10. A ski boot as in claim 1 which includes at least one expandable bladder mounted between a portion of the boot within the sheath means and a portion of the user's foot or ankle about which a close fit is desired, the bladder being comprised of a plurality of gas-filled, closed cells having elastic cell walls whereby the volume of the cells increases due to expansion of the contained gas responsive to a decrease in pressure within the sheath means when said partial vacuum is created, with the expansion of the cells causing the bladder to expand and closely fit against said portion of the user's foot or ankle.

* * * * *